US005238440A

United States Patent [19]

Morin

[11] Patent Number: 5,238,440

[45] Date of Patent: Aug. 24, 1993

[54] TOY TOP WITH POPPING BALLS

[75] Inventor: Andrew T. Morin, Pawtucket, R.I.

[73] Assignee: Playskool, Inc., Pawtucket, R.I.

[21] Appl. No.: 842,638

[22] Filed: Feb. 27, 1992

[51] Int. Cl.[5] ..... A63H 1/06; A63H 1/28; A63H 5/00

[52] U.S. Cl. ..... 446/241; 446/266; 446/413; 446/420; 273/142 E; 273/142 R; 273/147

[58] Field of Search ..... 446/241, 140, 256, 259, 446/264, 265, 266, 227, 236, 246, 269, 270, 271, 272, 409, 413, 414, 418, 419, 420; 273/144 R, 145 CA, 145 D, 145 E, 142 E, 142 R, 147

[56] References Cited

U.S. PATENT DOCUMENTS

| | | | |
|---|---|---|---|
| 1,462,870 | 7/1923 | Rogers | 273/147 X |
| 1,555,848 | 10/1925 | Hunau et al. | 273/142 E |
| 1,626,148 | 4/1927 | Obrist . | |
| 2,462,686 | 2/1949 | Stallard . | |
| 2,831,692 | 4/1958 | Keast . | |
| 2,937,475 | 5/1960 | Crawford | 446/409 |
| 3,084,478 | 8/1960 | Burger . | |
| 3,195,896 | 7/1965 | Markham | 273/142 R X |
| 3,898,762 | 8/1975 | Balleis . | |
| 4,355,481 | 10/1982 | Joslyn . | |
| 4,610,638 | 9/1986 | Iwao et al. . | |
| 4,618,330 | 10/1986 | Abe | 446/236 |
| 4,639,232 | 1/1987 | Wang . | |
| 4,643,692 | 2/1987 | Magers | 446/236 X |

FOREIGN PATENT DOCUMENTS

| | | | |
|---|---|---|---|
| 2257195 | 6/1974 | Fed. Rep. of Germany | 446/241 |
| 607730 | 2/1947 | United Kingdom | 273/142 E |

*Primary Examiner*—D. Neal Muir

*Attorney, Agent, or Firm*—Salter, Michaelson & Benson

[57] ABSTRACT

A toy top comprises a base plate having a plurality of apertures therein, a rotatable disk which is mounted beneath the base plate, a plurality of balls which are received on the base plate and a transparent dome enclosing the balls and the base plate. The device is operative by depressing a central plunger to rotate the disk beneath the base plate. The rotatable disk has a plurality of projections thereon which pass beneath the apertures in the base plate so that they engage any of the balls received in the apertures to bump or pop the balls out of the apertures as the disk is rotated.

11 Claims, 2 Drawing Sheets

TOY TOP WITH POPPING BALLS

BACKGROUND OF THE INVENTION

The instant invention relates to toys, and more particularly relates to a toy top having a plurality of movable balls enclosed within a transparent dome.

Spinning tops are well known in the toy art. In this regard, many of the heretofore available toy tops have been constructed so that the entire tops spin when actuated, and so that as a result, they tend to travel over supporting surfaces while spinning. However, it has been found that younger children, for example children of the ages from 1 to 3 years, frequently have not developed the necessary coordination for actuating free-spinning tops. Accordingly, it has been determined that small children frequently have difficulty playing with free-spinning tops, and thus many of the prior art tops have been found to have little play value for younger children.

In order to increase the play value of toy tops for younger children, stationary spinning tops have been proposed In this regard, the U.S. Pat. No. 3,084,478; to Burger, No. 4,355,481; to Joslyn and No. 3,898,762 to Balleis, disclose devices of this type and represent the closest prior art to the subject invention of which the applicant is aware. Generally, the devices disclosed in the Burger, Joslyn, and Balleis Patents include stationary bases, twisted rod actuators, and various ornamental members which rotate within the tops. The device disclosed in the Burger reference further discloses a toy top having moving balls. Various other spinning and agitating devices which are believed to be only of general interest with respect to the subject invention are disclosed in the U.S. Pat. No. 1,626,148; to Obrist, No. 2,462,686; to Stallard, No. 2,831,692; to Keast to No. 4,710,638; to Iwao et al, and No. 4,639,232 to Wang.

SUMMARY OF THE INVENTION

The instant invention provides a stationary spinning top having a plurality of moveable balls which are enclosed within a transparent dome and bounced around therein as a central portion of the top spins. Briefly, the toy top comprises a circular base having a center hub, a rotatable disk mounted on the hub, an apertured base plate mounted on the base over the rotating disk, a transparent dome enclosing the base plate and the rotatable disk, a plurality of balls received on the base plate, and a twisted rod and clutch mechanism for rotating the disk. The top is operable by depressing a central plunger which is attached to the twisted rod and clutch mechanism to rotate the rotatable disk beneath the base plate. The rotatable disk has a pair of spaced tabs thereon which are positioned such that they travel in an arcuate path beneath the apertures in the base plate and engage any of the balls received in the apertures to pop or propel the balls out of the apertures as the disk is rotated.

Therefore, it is an object of the instant invention to provide a toy top which remains stationary when a central portion thereof is rotated.

It is another object of the instant invention to provide a toy top which is simple for small children to operate.

It is yet another object to provide a toy top having a plurality of movable balls which are enclosed within a transparent dome and bounced around therein as a portion of the top is rotated.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
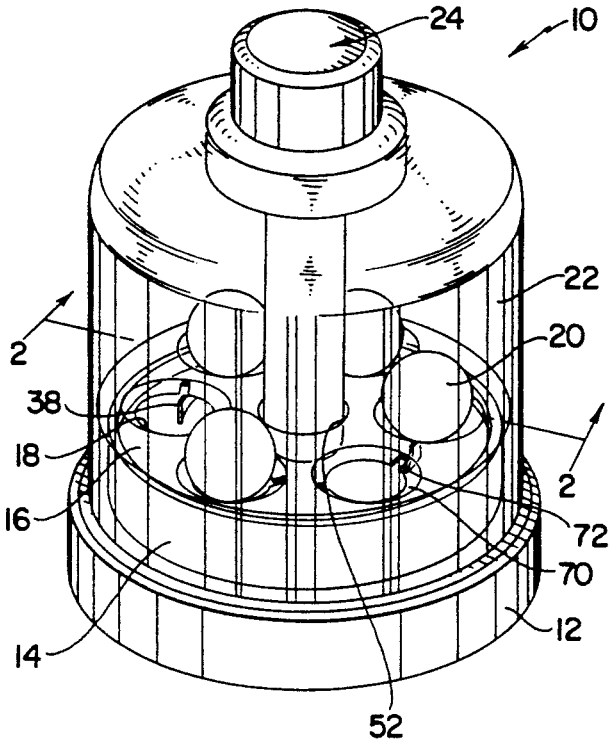
FIG. 1 is a perspective view of the toy top of the instant invention.

Referring now to the drawings, the toy top of the instant invention is illustrated and is generally indicated at 10 in FIG. 1. The toy top 10 comprises a base 12, a rotatable disk assembly 14, a base plate 16 having a plurality of apertures 18 therein, a plurality of balls 20, a transparent dome 22, and a twisted rod and clutch mechanism generally indicated at 24.

Figure 2:
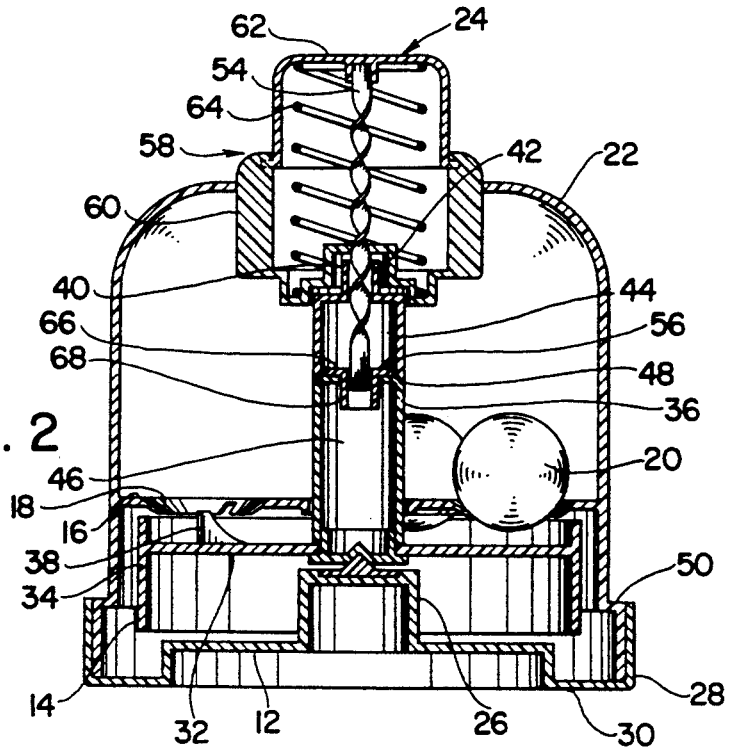
FIG. 2 is a sectional view taken along line 2—2 of FIG. 1.

Referring now to FIGS. 1 and 2, the base 12 is adapted for supporting the top 10 on a flat surface, such as a floor or a table, and it includes an inner hub portion 26 and an outer lip portion 28 which extend upwardly from a flat bottom surface 30.

The rotatable disk assembly 14 is rotatably mounted on the end of the hub 26, and it comprises a circular plate 32, a circumferential wall 34 extending around the outer perimeter of the plate 32, a cylindrical neck portion 36 extending upwardly from the circular plate 32, and a pair of spaced tabs 38 projecting upwardly from the circular plate 32. The outer surface of the circumferential wall 34 preferably includes a spiral design, such that when the disk 14 is rotated the design gives the appearance of an upwardly advancing spiral. It is contemplated that other designs having similar rotating effects will also be utilized. The outer surface of the cylindrical neck portion 36 preferably also includes a spiral design to give an additional spiral rotation effect to the top 10. The cylindrical neck portion 36 has a reduced upper end portion 40 which has an aperture 42 formed therein, and it includes upper and lower hollow chambers 44 and 46, respectively, which are separated by a partition 48.

The dome 22 is preferably integrally molded in a rounded configuration from a transparent plastic, and it has an aperture in the upper end thereof and a slightly enlarged depending base portion 50 on the lower end thereof. The base portion 50 of the dome 22 is received in the base 12 adjacent to the inner side of the lip portion 28 such that the dome 22 encloses the rotatable disk 14.

As can be seen in FIG. 2, the base plate 16 is integrally formed with the dome 22, and as such it is also transparent. The base plate 16 is oriented within the dome 22, such that it is positioned in closely spaced relation over the disk 14. The base plate 16 has six circumferentially spaced apertures 18 formed therein, and it also includes a center aperture 52 through which the neck portion 36 of the disk 14 extends. The base plate 16 and the dome 22 define a substantially enclosed space in which four lightweight, moveable balls 20 are received. When the balls 20 are stationary within the enclosed space they are received on the base plate 16. The balls 20 have a larger diameter than the apertures 18 in the base plate 16 and they are preferably fashioned from a stiff, yet resilient plastic material so that they are able to bounce within the dome 22. Further, the balls 20 are dimensioned so that when the balls 20 are received in the apertures 18 in the base plate 16 a portion of each of the balls 20 extends downwardly through the respective aperture 18 thereof and is positioned beneath the base plate 16.

The twisted rod and clutch mechanism 24 is operable for imparting a unidirectional rotation to the rotatable disk 14, and it comprises a spirally twisted reciprocating drive rod or strip 54, a friction clutch generally indicated at 56, and a spring-biased plunger generally indicated at 58 which is operative for reciprocating the drive rod 54 toward and away from the disk 14. The plunger 58 comprises a housing 60, a cap 62, and a coil spring 64. The housing 60 is received in the aperture in the upper end of the dome 22 such that a lower portion of the housing 60 is disposed within the dome 22 and is matingly received on the reduced end portion 40 of neck 36. The plunger cap 62 is received in the aperture in the upper portion of the housing 60, and it is biased toward an upwardly extending position by the spring 64. The clutch 56 comprises a drive disk portion 66 having a centrally disposed rectangular slot therein, and a guide neck portion 68 extending downwardly from the bottom of the drive disk portion 66. The clutch 56 is disposed inside the upper chamber 44 of the neck portion 36 of the rotatable disk assembly 14, such that the guide neck portion 68 extends through the partition 48. The drive rod 54 is attached to the inside of the plunger cap 62, and it extends downwardly through an aperture in the bottom of the housing 60, through the aperture 42 in the reduced end portion 40 of neck 36, and finally through the rectangular slot in the clutch 56.

The twisted rod and clutch mechanism 24 is operable for effecting rotation of the disk assembly 14, such that when the plunger 58 is depressed, the drive rod 54 slides downwardly through the rectangular slot in the clutch 56 causing the clutch 56 to frictionally engage the partition 48 of neck portion 36. In this manner, as the drive rod 54 passes through the rectangular slot in the clutch 56, the twisted configuration of the drive rod 54 imparts rotation to rotatable disk 14. When the plunger 58 is released, the drive strip 54 is biased upwardly and away from the disk assembly 14, so that the clutch 56 is disengaged from the partition 48 to permit free rotation of the rotatable disk 14.

Figure 3:
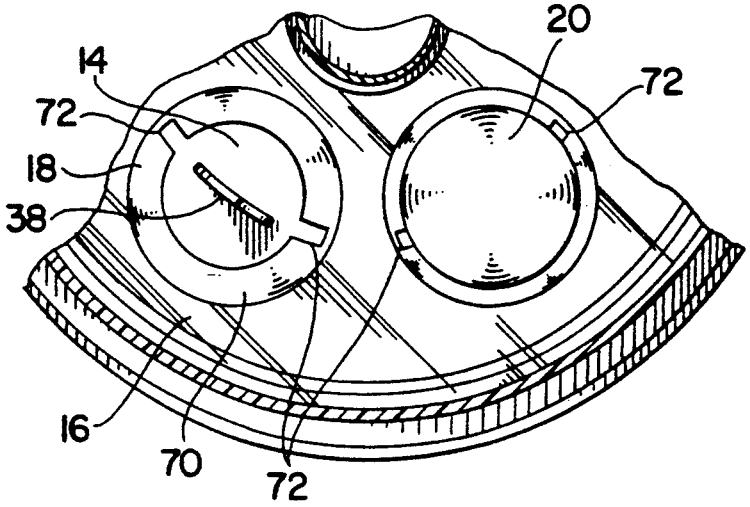
FIG. 3 is a fragmentary plan view thereof.
Figure 4:
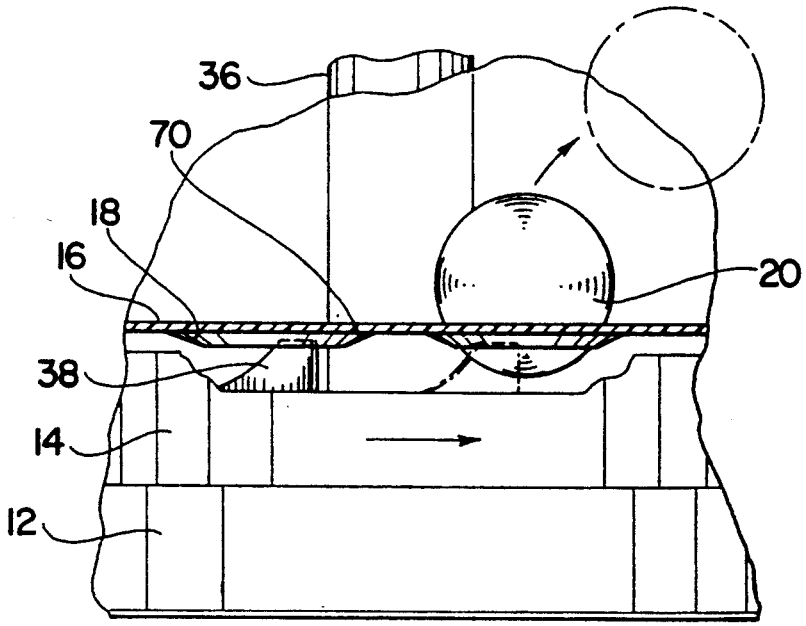
FIG. 4 is a fragmentary side view thereof.

Referring now to FIGS. 3 and 4, the spaced tabs 38 of the disk 14 are positioned such that they travel in an arcuate path which extends beneath the apertures 18 in the base plate 16. Hence, as the disk 14 is rotated, the spaced tabs 38 pass beneath the apertures 18 and engage any of the balls 20 received in the apertures 18. In this regard, the tabs 38 are constructed so that they forcibly strike the balls 20 to propel them out of the apertures 18 to cause the balls 20 to bounce around the inside of the dome 22. As can be seen most clearly in FIGS. 1 and 3, the base plate 16 includes conically tapered seat portions 70 which surround the apertures 18 and which have cut-out sections 72 corresponding to the path of rotation of the projecting tabs. The tapered seat portions 70 allow the balls 20 to be more easily received in the apertures 18, and the cut-out sections 72 permit the projecting tabs 38 to pass beneath the apertures without engaging the seat portions 70. In this regard, the tapered seat portions 70 of the surrounding apertures 18 allow the balls 20 to be seated in the apertures 18, so that the lower portions of the balls are disposed below the base plate 16 to allow the balls 20 to be popped out of the apertures 18 by the tabs 38.

It is seen therefore that the spinning top of the instant invention provides an amusing toy for small children. The toy top is adapted to remain stationary on a supporting surface and it includes a simple actuator mechanism in the form of a plunger which can be effectively utilized by children of any age. Even further, the top includes a plurality of balls 20 which are popped and bounced around inside the transparent dome 22 by the rotatable disk 14 with the projecting tabs 38. It has been found that the simple plunger-type actuator, the popping balls, and the stationary base substantially increase the play value of the top 10, and hence, it is seen that the instant invention represents significant advancements in the toy top art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy top comprising:

a base having a central hub;

a rotatable member mounted on said hub;

a base plate mounted over said rotatable member, said base plate having a plurality of spaced apertures therein;

a plurality of spaced projections projecting upwardly from said rotatable member, said projections being positioned on said rotatable member such that said projections travel in an arcuate path which extends beneath said apertures in said base plate;

a transparent enclosure mounted over said base plate, said enclosure and said base plate defining a substantially enclosed space above said base plate;

a plurality of moveable balls which are received within said enclosed space on top of said base plate; and means for rotating said rotatable member such that said projections pass beneath said apertures in said base plate and engage any of said balls which are received in said apertures to propel them out of said apertures as said rotatable member is rotated.

2. In the toy top of claim 1, said rotatable member comprising a disk.

3. In the toy top as claimed in claim 2, said disk comprising a circular plate mounted on said hub, a circumferential wall extending around an outer perimeter of said circular plate, and a cylindrical neck portion extending up from said circular plate.

4. In the toy top of claim 3, said circumferential wall and said cylindrical neck portion including a spiral design such that when said disk is rotated said design gives the appearance of an upwardly advancing spiral.

5. In the toy top of claim 1, said base plate further including conically tapered seat portions which surround said apertures and project downwardly from said base plate toward said rotatable member.

6. In the toy top of claim 5, said seat portions including cut-out sections which correspond to said arcuate path of rotation of said projections, said cut-out sections permitting said projections to rotate in closely spaced relation to said base plate without engaging said seat portions.

7. In the toy top of claim 1, said plurality of projections comprising a pair of spaced tabs.

8. In the toy top of claim 1, said transparent enclosure comprising a dome.

9. In the toy top of claim 1, said apertures having a diameter, said balls having a diameter which is at least slightly larger than the diameter of said apertures such that said balls are prevented from passing through said apertures, but also such that said balls are receivable in said apertures so that a portion of each of said balls extends downwardly through the respective aperture thereof.

10. In the toy top of claim 1, said rotation means comprising a twisted rod and clutch means.

11. In the toy top of claim 10, said twisted rod and clutch means comprising a spirally twisted reciprocating drive rod which is partially disposed within said transparent enclosure, clutch means slidably mounted on said drive rod for engaging and rotating said rotatable member, and biasing means for reciprocating said drive rod toward and away from said rotating member.

* * * * *